US012758071B2

(12) United States Patent
Wang et al.

(10) Patent No.: US 12,758,071 B2
(45) Date of Patent: Oct. 13, 2026

(54) SELF-CLEANING FLOOR SCRUBBING MACHINES

(71) Applicant: SUZHOU XINQINGSONG INTELLIGENT TECHNOLOGY CO., LTD., Suzhou (CN)

(72) Inventors: Xiaosong Wang, Suzhou (CN); Linling Qin, Suzhou (CN)

(73) Assignee: Suzhou Bob-Home Intelligent Technology Co., Ltd., Jiangsu (CN)

( * ) Notice: Subject to any disclaimer, the term of this patent is extended or adjusted under 35 U.S.C. 154(b) by 466 days.

(21) Appl. No.: 18/692,061

(22) PCT Filed: Apr. 15, 2022

(86) PCT No.: PCT/CN2022/087087
§ 371 (c)(1),
(2) Date: Mar. 14, 2024

(87) PCT Pub. No.: WO2022/218412
PCT Pub. Date: Oct. 20, 2022

(65) Prior Publication Data

US 2025/0017431 A1 Jan. 16, 2025

(30) Foreign Application Priority Data

Apr. 16, 2021 (CN) ..... 202120785797.6

(51) Int. Cl.
*A47L 11/292* (2006.01)
*A47L 11/30* (2006.01)
*A47L 11/40* (2006.01)

(52) U.S. Cl.
CPC ..... *A47L 11/292* (2013.01); *A47L 11/30* (2013.01); *A47L 11/4013* (2013.01)

(58) Field of Classification Search
CPC .... A47L 11/292; A47L 11/30; A47L 11/4013; A47L 9/0477; A47L 11/282; A47L 11/40; A47L 11/4041; A47L 11/4069
See application file for complete search history.

(56) References Cited

FOREIGN PATENT DOCUMENTS

| | | | | |
|---|---|---|---|---|
| CN | 111166252 A | * | 5/2020 | ..... A47L 11/282 |
| CN | 211534261 U | * | 9/2020 | |
| CN | 116407014 A | * | 7/2023 | ..... A47L 11/292 |

* cited by examiner

*Primary Examiner* — Marc Carlson
(74) *Attorney, Agent, or Firm* — Joe Zheng

(57) ABSTRACT

A self-cleaning floor scrubbing machine is disclosed in the present invention. The self-cleaning floor scrubbing machine comprises a roller brush, a dirt holding tank, a threaded water pumping and conveying rod, and a water blocking cover. A length direction of the dirt holding tank is the same as an axial direction of the roller brush. The dirt holding tank is located on one side of the roller brush. An opening is provided on a side of the dirt holding tank facing the roller brush. An axial direction of the threaded water pumping and conveying rod is the same as that of the roller brush. The threaded water pumping and conveying rod is mounted in the dirt holding tank. A drain outlet is disposed on the dirt holding tank. The water blocking cover is arranged above the roller brush. One end of the water blocking cover extends to the dirt holding tank.

15 Claims, 10 Drawing Sheets

SELF-CLEANING FLOOR SCRUBBING MACHINES

FIELD OF THE INVENTION

The present invention relates to the field of floor cleaning, and in particular relates to a self-cleaning floor scrubbing machine.

BACKGROUND TECHNOLOGY

A conventional floor cleaning mode refers to mopping a floor with a common mop. The operating time of using the conventional mop is short, and it is needed to clean the mop constantly, making it troublesome to clean the floor and difficult to squeeze out dirty water thoroughly. The conventional floor cleaning is time-consuming and laborious. To solve the problems, floor scrubbers emerged on the market. Although the latest scrubbers claim to have dry and wet sweeping and mopping functions, these functions are realized by using a scraper to remove water stains on the roller brush. However, the scraper cannot achieve a "dry-mopping" effect without water stains and cannot remove dirt and dirty water effectively. Moreover, products with these functions are expensive, complex in structural design and easy to damage. For these products, if the scraper applies a large pressure to the roller brush and scrape water excessively, a high resistance would be produced, and the roller brush may be damaged. Moreover, no matter how much pressure is applied by the scraper to the roller brush, dirty water and dirt cannot be removed sufficiently. This is because the fixed scraper and the rotating roller brush body are in surface-to-surface contact, causing a high frictional resistance and low squeezing efficiency. Moreover, the scraper and the roller brush are easily damaged, and a high resistance is applied to the roller brush. On the contrary, if the scraper applies a low pressure to the roller brush, the dirty water on the roller brush body would not be removed effectively, making the roller brush body prone to form water stains on the floor.

Therefore, in combination with the above problems, it is necessary to provide solutions to overcome at least these problems.

SUMMARY OF THE INVENTION

One of the objectives in the present invention is to provide a floor scrubbing machine capable of achieving self-cleaning of a roller brush. According to one aspect of the present invention, a self-cleaning floor scrubbing machine is described. The self-cleaning floor scrubbing machine comprises a roller brush, a dirt holding tank, a threaded water pumping and conveying rod and a water blocking cover. A length direction of the dirt holding tank is the same as an axial direction of the roller brush; the dirt holding tank is located on one side of the roller brush; an opening is provided on a side of the dirt holding tank facing the roller brush; an axial direction of the threaded water pumping and conveying rod is the same as that of the roller brush; the threaded water pumping and conveying rod is rotatably mounted in the dirt holding tank; the dirt holding tank is provided with at least one drain outlet; the water blocking cover is arranged above the roller brush; and one end of the water blocking cover extends to the dirt holding tank.

According to another aspect of the present invention, the self-cleaning floor scrubbing machine comprises a press or pressure roller located above the dirt holding tank and configured to press one side of the roller brush, wherein an axial direction of the pressure roller is the same as that of the roller brush; and/or a plurality of first protrusion structures and/or a plurality of first hairbrush structures arranged on one side of the roller brush and configured to abut against the roller brush.

According to still another aspect of the present invention, the first protrusion structures and/or the first hairbrush structures are arranged at an upper edge of the opening of the dirt holding tank.

According to still another aspect of the present invention, the self-cleaning floor scrubbing machine comprises a scrubbing roller shaft arranged on one side of the roller brush, wherein an axial direction of the scrubbing roller shaft is the same as that of the roller brush, and the first protrusion structures and/or the first hairbrush structures are arranged on the scrubbing roller shaft.

According to still another aspect of the present invention, the scrubbing roller shaft is located below the pressure roller.

According to still another aspect of the present invention, the scrubbing roller shaft is in a hollow tubular shape, the scrubbing roller shaft is provided with a plurality of water holes and at least one water inlet, and the water holes and the at least one water inlet are respectively communicated with an inner cavity of the scrubbing roller shaft.

According to still another aspect of the present invention, a scrubbing housing is sleeved over the scrubbing roller shaft; the scrubbing roller shaft is configured to rotate in the scrubbing housing; the first protrusion structures and/or the first hairbrush structures on the scrubbing roller shaft are spirally arranged; an opening is provided on a side of the scrubbing housing facing the roller brush; the scrubbing housing is provided with at least one water inlet; and the least one water inlet is communicated with an inner cavity of the scrubbing housing.

According to still another aspect of the present invention, a threaded groove is formed in a surface of the pressure roller.

According to still another aspect of the present invention, a pressure roller housing is sleeved over the pressure roller; the pressure roller is configured to rotate in the pressure roller housing; an opening is provided on a side of the pressure roller housing facing the roller brush; the pressure roller housing is provided with at least one water inlet and at least one water outlet; and the at least one water outlet is communicated with an inner cavity of the pressure roller housing and an inner cavity of the dirt holding tank.

According to still another aspect of the present invention, a pressing degree of tightness between the pressure roller and the roller brush is adjustable.

According to still another aspect of the present invention, the threaded water pumping and conveying rod presses one side of the roller brush.

According to still another aspect of the present invention, the dirt holding tank is provided with at least one water inlet; a guide structure extends from a lower edge of the opening of the dirt holding tank, and an extended end of the guide structure inclines downwards; the drain outlet of the dirt holding tank is connectable to a suction machine; the threaded water pumping and conveying rod is provided with a plurality of second protrusion structures and/or a plurality of second hairbrush structures; and the threaded water pumping and conveying rod is a shaftless helical rod.

According to still another aspect of the present invention, the self-cleaning floor scrubbing machine further comprises a scraping brush, wherein an axial direction of the scraping brush is the same as that of the roller brush, the scraping brush is located on one side of the pressure roller in a rotating direction of the roller brush, and the scraping brush presses one side of the roller brush.

According to still another aspect of the present invention, the self-cleaning floor scrubbing machine further comprises a driving machine, wherein the driving machine is configured to drive the roller brush to rotate.

According to yet another aspect of the present invention, the self-cleaning floor scrubbing machine further comprises an electricity storage machine, the electricity storage machine being electrically connected to the driving machine.

The self-cleaning floor scrubbing machine described in the present invention has at least the following one or more beneficial effects. This patent can implement the functions of "drying", "cleaning", and "self-cleaning" at the same time. "Drying" means that fewer water stains are left by the roller brush treated by a pressure roller. "Cleaning" means that the dirt on the floor can be cleaned by way of transporting of a helical rod, and sweeping and mopping are integrated. "Self-cleaning" means that the roller brush can be self-cleaned by way of conveying of the clear water and pressing of the pressure roller of this patent, which is more ergonomic, greatly improves the user experience, and overcomes the shortcomings of existing products.

The self-cleaning floor scrubbing machine of the present invention is provided with the dirt holding tank and the threaded water pumping and conveying rod, and the rotary threaded groove of the threaded water pumping and conveying rod is ingeniously utilized to form a dirty water and dirt transport channel, making it more favorable to lead out the dirty water and dirt.

Moreover, if the threaded water pumping and conveying rod is designed to be abut against the roller brush, protruding threads of the threaded water pumping and conveying rod squeeze the roller brush body rotatably. The threaded water pumping and conveying rod and the roller brush are two cylinders which rotate oppositely and squeeze each other, so that a lower resistance and a better squeezing effect are produced, and it is more favorable to squeeze out the dirty water to remove dirt.

Further, if the dirt holding tank and the threaded water pumping and conveying rod are connected to a suction machine, the dirty water or dirt in the dirt holding tank can be sucked to a designated position such as an accommodation machine; or, if they are not connected to the suction machine, the dirty water or dirt in the dirt holding tank can also be discharged by way of a spiral thrust generated by the rotary threaded water pumping and conveying rod in the dirty water tank.

Further, the threaded water pumping and conveying rod matches with a water tank and a water pumping machine to guide water in the water tank to a cleaning layer of the roller brush, then the cleaning layer is squeezed and kneaded, and the dirty water and dirt after cleaning are led into the water tank to implement self-cleaning of the roller brush, so that it is more favorable for design of an overall product.

Moreover, the threaded water pumping and conveying rod can transport daily dirt such as noodles, soybeans and rice grains to the dirty water tank. The threaded water pumping and conveying rod is designed detachably, and can be conveniently detached for cleaning after use.

Further, by additionally providing the pressure roller or a brush roller, the patent can further enhance a cleaning effect to the roller brush to implement the "dryness" function. The "dryness" means that fewer water stains are left on the roller brush squeezed by the pressure roller. The pressure roller replaces an original scraper. The pressure roller and the roller brush are another two cylinders which rotate oppositely and squeeze each other to further squeeze the roller brush, so that water is further squeezed out. Moreover, large particle dirt can be blocked to a certain extent, the resistance to the roller brush is lower, the driving power of the roller brush is reduced, and the cost is reduced.

Further, the pressure roller can adjust a distance between the pressure roller and the roller brush as needed, so as to control the wetting degree and the cleaning degree of the roller brush. The scrubbing machine of the present invention can also use various water supplementation modes such as water supplementation by the pressure roller or water supplementation by the brush roller or directly provided by a water injection nozzle. The product design is higher in operability.

Further, the brush roller is arranged below the pressure roller to prevent water accumulation below the pressure roller as the roller brush and the pressure roller oppositely squeeze each other rapidly, thereby playing a guiding role. Moreover, the roller brush rotates to drive the brush roller to rotate, so that the dirty water or dirt squeezed by the pressure roller can be thrown into the dirt holding tank, and therefore, the dirt on the surface of roller brush can be eliminated.

Further, the pressure roller can further be provided with a scraping brush on another side of the rotating direction of the roller brush. The scraping brush can be either another rotary brush roller or a non-rotatable brush. Applied or adhered wool or sponge squeezed by the pressure roller on the surface of the roller brush can be taken up or brushed up again to become fluffy, so that adsorption capacity of the roller brush and a friction force to the floor are effectively improved, and the cleaning effect of the machine is improved.

Figure 1:
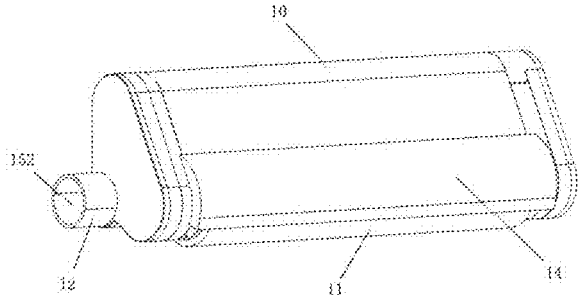
FIG. 1 is a schematic structural view of a scrubbing machine according to Embodiment I of the present invention.

In the figures, 1—scrubbing machine, 10—housing, 11—roller brush, 111—cleaning layer, 12—dirt holding tank, 121—guide structure, 122—first mounting member, 123—second mounting member, 124—drain outlet, 125—water inlet, 13—threaded water pumping and conveying rod, 131—protrusion structure or hairbrush structure, 14—water blocking cover, 15—pressure roller, 151—pressure roller housing, 1511—water outlet, 152—expansion member, 16—first protrusion structure or first hairbrush structure, 17—first brush roller, 171—scrubbing roller shaft, 1711—water hole, 172—scrubbing housing, 18—second brush roller, 19—driving machine, 191—electricity storage machine, 2—suction machine, 3—accommodation machine, 31—dirty water cavity, 32—clean water cavity, 33—separation structure, 34—filter machine, 4—water pumping machine, 5—standby water tank, 6—blowing machine, and 61—air hole.

DETAILED DESCRIPTION OF THE PREFERRED EMBODIMENTS

In order to further illustrate technical means and functions adopted to achieve predetermined objective of the present invention, detailed description is made on specific embodiments, structure, features and functions thereof of the present invention below in combination with drawings and preferred embodiments. According to one embodiment (Embodiment I), FIG. 1 to FIG. 4 show collectively a self-cleaning floor scrubbing machine according to one embodiment of the present invention. The self-cleaning floor scrubbing machine comprises a roller brush 11, a dirt holding tank 12, a threaded water pumping and conveying rod 13 and a water blocking cover 14. The roller brush 11 is a water-absorbent roller brush 11. The roller brush 11 usually comprises a water-absorbent plush cotton roller brush or a water-absorbent sponge roller brush such as polyvinyl alcohol sponge, i.e., a cleaning layer 111 is made of wool or sponge. A length direction of the dirt holding tank 12 is the same as an axial direction of the roller brush 11, the dirt holding tank 12 is located on one side of the roller brush 11, and an opening is provided on a side of the dirt holding tank 12 facing the roller brush 11. An axial direction of the threaded water pumping and conveying rod 13 is the same as that of the roller brush 11, and the threaded water pumping and conveying rod 13 is rotatably mounted in the dirt holding tank 12. By providing the threaded water pumping and conveying rod 13 in the dirt holding tank 12, the rotary threaded groove of the threaded water pumping and conveying rod 13 is ingeniously utilized to form a dirty water and dirt transport channel, so that it is more favorable to lead out the dirty water and dirt. Preferably, the threaded water pumping and conveying rod 13 abuts against the roller brush 11, i.e., the threaded water pumping and conveying rod 13 presses the cleaning layer 111 of the roller brush 11. When the roller brush 11 rotates, it will drive the threaded water pumping and conveying rod to rotate. The protruding threads of the threaded water pumping and conveying rod 13 squeeze the cleaning layer 111 of the roller brush 11 rotatably. The threaded water pumping and conveying rod 13 and the roller brush 11 are two cylinders which rotate oppositely and squeeze each other, so that a lower resistance and a better squeezing effect are produced, and it is more favorable to squeeze out the dirty water to remove dirt. Of course, the threaded water pumping and conveying rod 13 may not abut against the roller brush 11, and in this case, the threaded water pumping and conveying rod 13 only plays transporting and dirty water guiding roles. The threaded water pumping and conveying rod 13 can transport daily dirt such as noodles, soybeans and rice grains.

Figure 2:
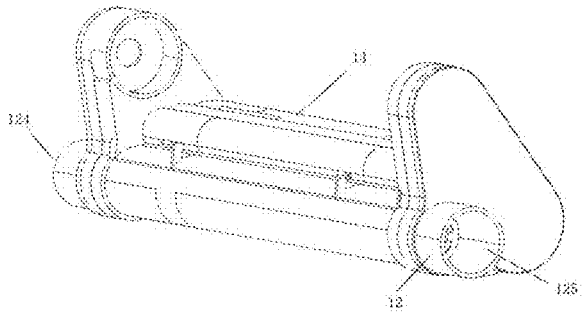
FIG. 2 is a schematic structural view of the scrubbing machine without a housing according to Embodiment I of the present invention.
Figure 3:
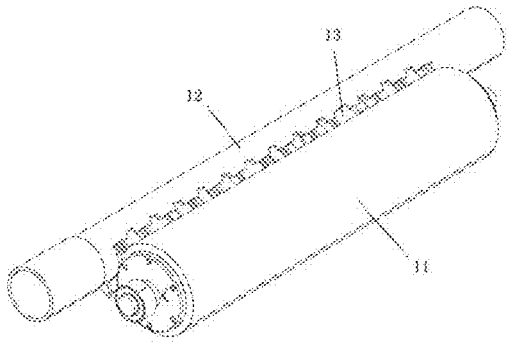
FIG. 3 is a schematic view showing a mounting position relationship between a roller brush and a dirt holding tank according to Embodiment I of the present invention.

The dirt holding tank 12 is provided with at least one drain outlet 124. As shown in FIG. 2, it is schematically shown that an end of the dirt holding tank 12 is provided with the drain outlet 124. In an implementation, a position of the drain outlet 124 is not limited. The drain outlet can be formed in any position of the dirt holding tank 12, for example a side wall and the like. The dirt holding tank 12 and the number of the drain outlets 124 can be adjusted as needed. The scrubbing machine in this embodiment can be externally connected to a suction machine 2 such as a vacuum cleaner to suck the dirty water or dirt in the dirt holding tank 12, or can be used without the suction machine 2. For example, one end of the dirt holding tank 12 is designed in a closed tubular structure adapted to the threaded water pumping and conveying rod, as shown in FIG. 3. The threaded water pumping and conveying rod rotates to form a rotary thrust in the tubular structure, so as to discharge the dirty water or dirt in the dirt holding tank 12 from the drain outlet 124. When an accommodation machine 3 such as a water tank is provided, the dirty water or dirt better can be collected and stored.

Preferably, the dirt holding tank 12 can further be provided with a water inlet 125, as shown in FIG. 1. When the water tank and the water pumping machine 4 are also provided, water in the water tank can be guided to the cleaning layer 111 of the roller brush 11, then the cleaning layer 111 is squeezed and kneaded, and the dirty water and dirt after cleaning are led into the water tank to implement self-cleaning and water supplementation of the roller brush 11, so that it is more favorable for design of an overall product. When the water inlet 125 is not formed or the water tank is not connected, i.e., the dirt holding tank 12 is not supplemented with water, the scrubbing machine of the present invention can also be used as a water absorption machine for mopping water stains on the floor and the like.

Figure 6:
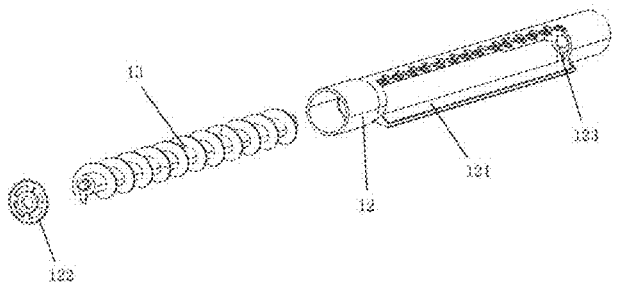
FIG. 6 is a schematic exploded view between the threaded water pumping and conveying rod and the dirt holding tank according to Embodiment I of the present invention.

Preferably, the threaded water pumping and conveying rod 13 is designed detachably, and can be conveniently detached for cleaning after use. As shown in FIG. 6, schematically shown is a washing assembly, where the water inlet 125 (a second water gap) is formed in an end in the length direction of the dirt holding tank 12. The threaded water pumping and conveying rod 13 can be detachably mounted in the dirt holding tank 12 through the water inlet 125. A first mounting member 122 is arranged at a position, close to the water inlet 125, in the dirt holding tank 12. The first mounting member 122 is detachably connected to the dirt holding tank 12. One end of the threaded water pumping and conveying rod 13 is rotatably connected to the first mounting member 122. The first mounting member 122 is provided with multiple through holes where the clean water pass through. The drain outlet 124 (a first water gap) of the dirt holding tank 12 is formed in an end of the length direction of the dirt holding tank 12. A second mounting member 123 is arranged at a position, close to the drain outlet 124, in the dirt holding tank 12. The second mounting member 123 is fixedly connected to the dirt holding tank 12. One end of the threaded water pumping and conveying rod 13 is rotatably connected to the second mounting member 123. The second mounting member 123 is provided with multiple through holes where the dirty water or dirt passes through. Of course, the above is only an implementation. In an implementation, an end, away from the water inlet 125, of the dirt holding tank 12 is a closed end. One end of the threaded water pumping and conveying rod 13 is rotatably connected to the closed end. The drain outlet 124 is formed in a position, close to the closed end, of the side wall of the dirt holding tank 12, which can also satisfy the design requirements.

Figure 7:
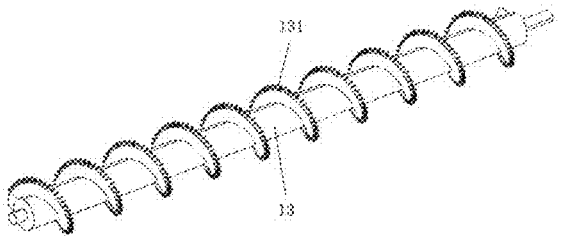
FIG. 7 is a schematic structural view of the threaded water pumping and conveying rod with protrusion structures or hairbrush structures according to Embodiment I of the present invention.
Figure 8:
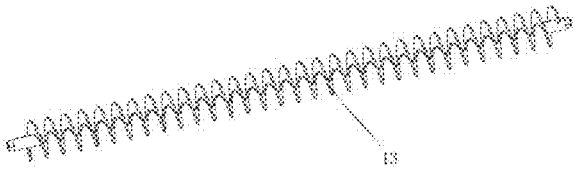
FIG. 8 is a schematic structural view of the threaded water pumping and conveying rod which is a shaftless helical rod according to Embodiment I of the present invention.

The threaded water pumping and conveying rod 13 can further be provided with multiple protrusion structures and/or hairbrush structures 131, as shown in FIG. 7. A friction force between the threaded water pumping and conveying rod 13 and the roller brush 11 can be improved, so that a cleaning effect of the roller brush 11 to the cleaning layer 111 is improved. In addition, the threaded water pumping and conveying rod 13 can also be a shaftless helical rod shown in FIG. 8, which can also satisfy the design requirements.

Figure 5:
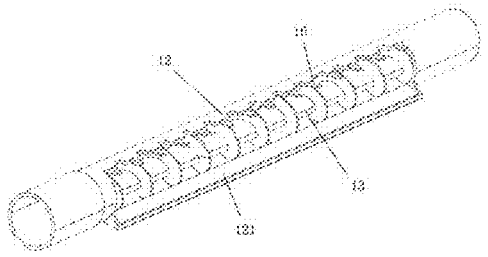
FIG. 5 is a schematic view showing a mounting position relationship between a threaded water pumping and conveying rod and the dirt holding tank according to Embodiment I of the present invention.

A guide structure 121 extends from a lower edge of the opening of the dirt holding tank 12. An end, away from dirt holding tank 12, of the guide structure 121 inclines downwards, as shown in FIG. 5 or FIG. 6. The structure is like the structure of a dustpan. In an implementation, the guide structure will be close to the floor and match with the roller brush 11, so that the cleaning capacity of the roller brush 11 can be improved, and dirty water leakage of the roller brush 11 is reduced.

Figure 4:
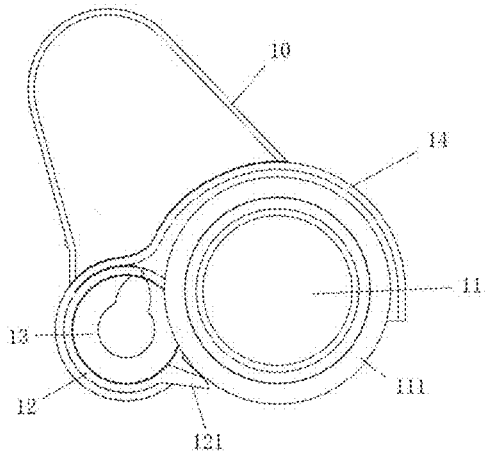
FIG. 4 is a schematic sectional structural view of the scrubbing machine provided in FIG. 3.

The water blocking cover is arranged above the roller brush 11 configured to shield the roller brush 11 to prevent the dirty water or dirt on the roller brush 11 from being thrown out of the machine, as shown in FIG. 4. One end of the water blocking cover 14 extends to the dirt holding tank 12. It should be known that the water blocking cover 14 and the dirt holding tank 12 can be separated, i.e., one end of the water blocking cover 14 is hermetically connected to the dirt holding tank 12 or the water blocking cover 14 and the dirt holding tank 12 are integrated. Regardless of the separated or integrated structures, such structures are provided to guarantee that the dirty water and dirt thrown by the roller brush 11 can smoothly enter the dirt holding tank 12.

Figure 9:
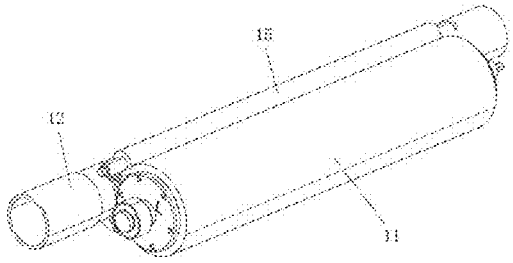
FIG. 9 is a schematic view showing a mounting position relationship among the roller brush, the dirt holding tank and a pressure roller according to in Embodiment I of the present invention.
Figure 10:
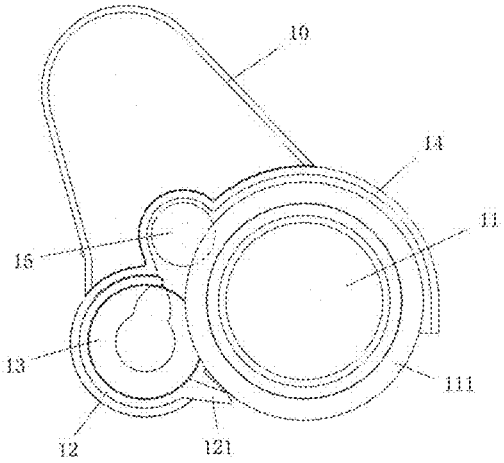
FIG. 10 is a schematic sectional structural view of the scrubbing machine provided in FIG. 9.
Figure 11:
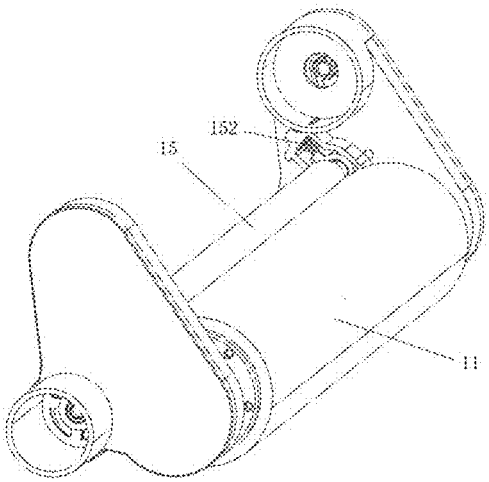
FIG. 11 is a schematic structural view of the scrubbing machine when the pressure roller is adjustable according to Embodiment I of the present invention.

In a further embodiment, a pressure roller 15 can be arranged on one side of the roller brush 11. As shown in FIG. 9, an axial direction of the pressure roller 15 is the same as that of the roller brush 11, the pressure roller 15 is located above the dirt holding tank 12, and the pressure roller 15 presses one side of the roller brush 11. Similarly, the pressure roller 15 is located below the water blocking cover 14 to prevent the dirty water or dirt on the pressure roller 15 from splashing, as shown in FIG. 10. When the roller brush 11 rotates, the roller brush 11 drives the pressure roller 15 to rotate. The pressure roller 15 rolls and squeezes the cleaning layer 111 on the surface of the roller brush 11 to squeeze out the dirty water in the cleaning layer 111 and the dirty water flows into the dirt holding tank 12. Moreover, the dirty water will take away part of dirt on the surface of the cleaning layer 111. A degree of tightness between the pressure roller 15 and the roller brush 11 is adjustable. For example, the degree of tightness is adjusted by way of a tensioning member or an expansion member 152, and the like. The mode shown in FIG. 11 is an expansion mode. The expansion members 152 are springs which are respectively arranged at both ends of the pressure roller 15. The springs are compressed all the time to guarantee that a certain pressure is kept between the pressure rod and the roller brush 11, so that the surface of the roller brush 11 can be better squeezed. Moreover, the pressure between the roller brush 11 and the pressure roller 15 can be adjusted by flexibly adjusting the elastic forces of the springs, i.e., the distance between the pressure roller 15 and the roller brush 11 is adjusted as needed to control the wetting degree and the cleaning degree of the roller brush 11. Of course, a tensioning mode or other modes can also be used to adjust the degree of tightness between the roller brush 11 and the pressure roller 15 as long as the degree of tightness between the pressure roller 15 and the roller brush 11 is within the protection scope of the present invention, which is not described repeatedly here. The pressure roller 15 and the roller brush 11 are another two cylinders which rotate oppositely and squeeze each other to further squeeze the roller brush 11, so that water is further squeezed out. Moreover, large particle dirt can be blocked to a certain extent, the resistance to the roller brush 11 is lower, the driving power of the roller brush 11 is reduced, and the cost is reduced. A threaded groove can further be arranged in the surface of the pressure roller 15, which can also satisfy the same effect.

In a further embodiment, the multiple first protrusion structures and/or multiple first hairbrush structures can be arranged on one side of the roller brush 11, and the first protrusion structures or the first hairbrush structures abut against the roller brush 11. The first hairbrush structures are preferably tufts. The following two modes for the first protrusion structures and/or the first hairbrush structures are provided:

Mode I: the first protrusion structures or the first hairbrush structures are arranged at an upper edge of the opening of the dirt holding tank 12, as shown in FIG. 5 or FIG. 6. The upper edge of the opening of the dirt holding tank 12 shown in the figure is zigzag for a purpose that the dirty water and dirt above the dirt holding tank 12 can smoothly enter the dirt holding tank 12. The first protrusion structures or the first hairbrush structures are respectively arranged on the zigzag structure of the upper edge. Of course, the first protrusion structures or the first hairbrush structures can also be arranged in a tooth space of the upper edge. It should be known that the edge of the opening of the dirt holding tank 12 can be only provided with the first protrusion structures or the first hairbrush structures. The edge of the opening of the dirt holding tank is provided with both the first protrusion structures and the first hairbrush structures. The first protrusion structures and the first hairbrush structures are both arranged in different modes as needed. In addition, the upper edge of the opening of the dirt holding tank 12 may not be zigzag, and it is also feasible that a gap is formed between the upper edge of the opening of the dirt holding tank and the roller brush 11.

Figure 12:
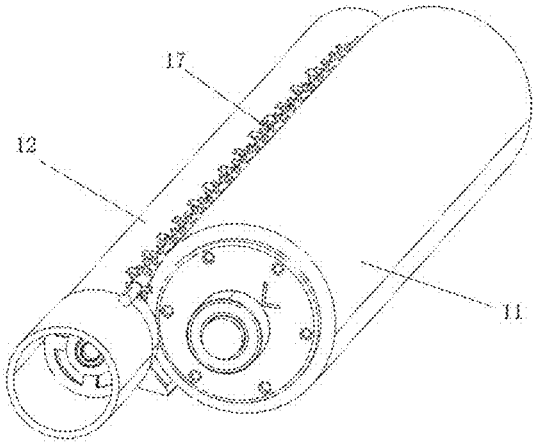
FIG. 12 is a schematic view showing a mounting position relationship among the roller brush, the dirt holding tank and a first brush roller according to Embodiment I of the present invention.

Mode II: the first protrusion structures or the first hairbrush structures are arranged on a scrubbing roller shaft 171, as shown in FIG. 12. The structure is also known as a first brush roller 17. An axial direction of the scrubbing roller shaft 171 is the same as that of the pressure roller 15, and the scrubbing roller shaft 171 is arranged on one side of the roller brush 11. Same as I, the scrubbing roller shaft 171 can be only provided with the first protrusion structures or the first hairbrush structures. The scrubbing roller shaft can also be provided with both the first protrusion structures and the first hairbrush structures. The first protrusion structures and the first hairbrush structures both can be arranged in different modes as needed.

Long or large dirt such as hairs and soybeans on the cleaning layer 111 of the roller brush 11 can be scraped into the dirt holding tank 12 through the first protrusion structures or the first hairbrush structures, and then the dirt is conveyed out of the dirt holding tank 12 by the threaded water pumping and conveying rod 13 or is pumped out by the suction machine 2.

Figure 13:
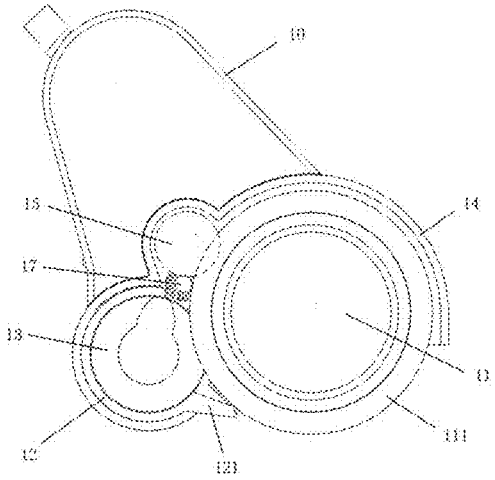
FIG. 13 is a schematic sectional structural view of the scrubbing machine provided with the first brush roller according to Embodiment I of the present invention.
Figure 14:
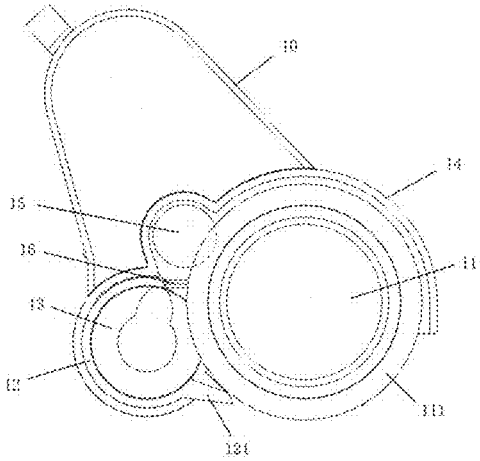
FIG. 14 is a schematic sectional structural view of the scrubbing machine when protrusion structures or hairbrush structures are arranged at an edge of the dirt holding tank according to Embodiment I of the present invention.

In a further embodiment, the scrubbing machine of the present invention can also be provided with both the pressure roller 15 and the first protrusion structures or the first hairbrush structures 16. The first protrusion structures or the first hairbrush structures 16 are arranged below the pressure roller 15, as shown in FIG. 13 or FIG. 14. Regardless of I or II above, the long or large dirt such as hairs and soybeans on the cleaning layer 111 of the roller brush 11 can be scraped in advanced before the pressure roller 15 rolls and squeezes the roller brush 11, so that the self-cleaning effect of the scrubbing machine is improved. Moreover, the dirty water generated by the pressure roller 15 squeezing the roller brush 11 can further flush the hairbrush structures or protrusion structures to take the dirt left on the hairbrush structures or protrusion structures into the dirt holding tank 12. In addition, in II, the roller brush 11 rotates to drive the scrubbing roller shaft 171 to rotate to play a certain draining role while cleaning the cleaning layer 111 of the roller brush 11, so as to prevent water accumulation below the pressure roller 15 because the roller brush 11 rotates too fast. The scrubbing roller shaft 171 drives the first protrusion structures or the first hairbrush structures to rotate to throw the dirty water and dirt squeezed by the pressure roller 15 into the dirt holding tank 12, so that the dirty water discharging capacity of the scrubbing machine is improved.

Figure 15:
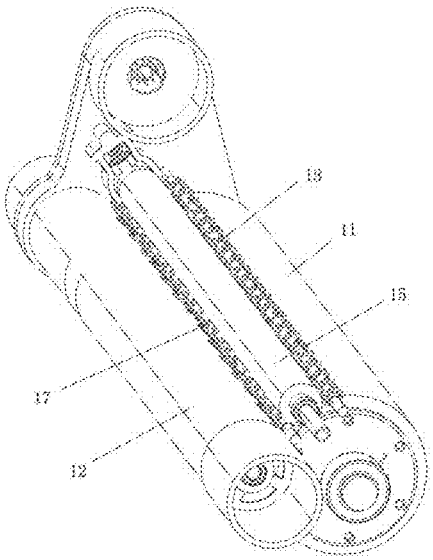
FIG. 15 is a schematic view showing a mounting position relationship among the roller brush, the dirt holding tank and the two brush rollers according to Embodiment I of the present invention.
Figure 16:
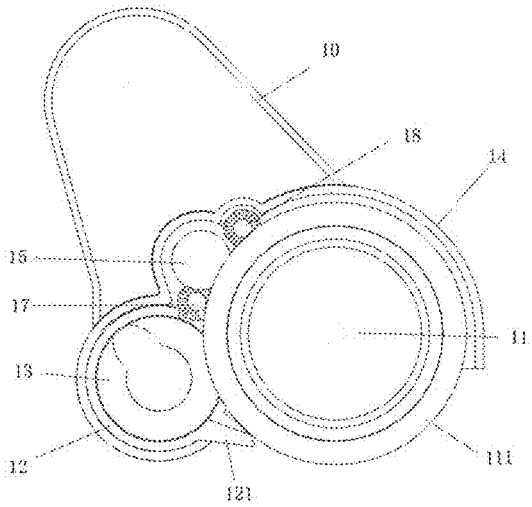
FIG. 16 is a schematic sectional structural view of the scrubbing machine provided in FIG. 15.

In a further embodiment, the pressure roller 15 can further be provided with one or more scraping brushes on one side of the rotating direction of the roller brush 11. The scraping brush can be a second brush roller 18. An axial direction of the second brush roller 18 is the same as that of the roller brush 11, and the brush roller presses one side of the roller brush 11, as shown in FIG. 15 and FIG. 16. The second brush roller 18 and the first brush roller 17 can be same in structure. In the above implementation that the cleaning effect of the cleaning layer 111 of the roller brush 11 is implemented by way of squeezing the roller brush 11 by the pressure roller 15, after long-term use or in a using process, the pressure roller 15 squeezes the surface of the roller brush 11 to a smooth surface, i.e., wool or sponge adhered, so that the adsorption capacity of the roller brush 11 is reduced, and the using effect is reduced. A brush roller is further arranged behind the pressure roller 15. The roller brush 11 rotates to drive the brush roller to roll, so that the protrusion structures or hairbrush structures on the brush roller will take up or brush up the wool or sponge on the surface of the roller brush 11, and therefore, adsorption capacity of the roller brush 11 and a friction force to the floor are effectively improved, and the cleaning effect of the machine is improved. It should be known that the scraping brush can also be a non-rotatable brush and the like, which, in a similar way, can satisfy the design requirements.

Figure 17:
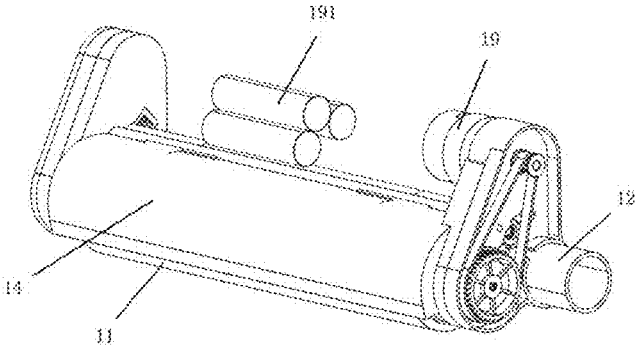
FIG. 17 is a schematic structural view of the scrubbing machine without a housing according to Embodiment I of the present invention.

In a further embodiment, the scrubbing machine further comprises a driving machine 19, where the driving machine 19 is configured to drive the roller brush 11 to rotate. The driving machine 19 is preferably a driving motor. FIG. 17 schematically shows a driving mode that the driving machine 19 is arranged outside the roller brush 11, for example, above the water blocking cover 14, and the roller brush 11 is driven by matching a driving belt with a gear. Of course, the driving machine 19 can also be arranged inside the roller brush 11 and the like, and driving modes used for driving the roller brush 11 all are within the protection scope of the present invention, which are not described repeatedly here.

In a further embodiment, the scrubbing machine further comprises an electricity storage machine 191, where the electricity storage machine 191 is electrically connected to the driving machine 19 to power the driving machine 19, as shown in FIG. 17. By additionally providing the electricity storage machine 191, the scrubbing machine can be used as an independent cleaning machine.

Figure 18:
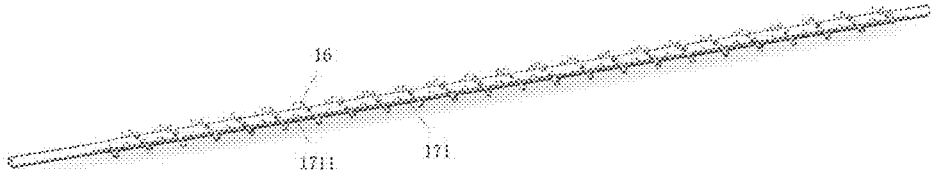
FIG. 18 is a structural schematic view of a first brush roller according to Embodiment II of the present invention.

According to one embodiment (Embodiment II), a scrubbing machine is configured to supplement water to the roller brush 11 through a first brush roller 17. As shown in FIG. 18, the scrubbing roller shaft 171 is designed in a hollow tubular shape, the scrubbing roller shaft 171 is provided with multiple water holes 1711 and at least one water inlet, and the water holes 1711 and the water inlets are respectively communicated with an inner cavity of the scrubbing roller shaft 171. After water is introduced through the water inlet, when the first brush roller 17 rotates, clean water in the scrubbing roller shaft 171 will be thrown onto the surface of the roller brush 11 through the water inlet to supplement water to the roller brush 11 conveniently. On the other hand, it further can implement cleaning the protrusion structures and the hairbrush structures on the scrubbing roller shaft 171. It should be known that the water supplementation mode in this embodiment is suitable for all implementations in Embodiment I. For example, the water supplementation mode can be suitable for either the implementation where water is not supplemented to the dirt holding tank 12 or implementation where water is supplemented to the dirt holding tank 12. Or, the water supplementation mode can be suitable for either the implementation with the pressure roller 15 or the implementation without the pressure roller 15 and the like.

Figure 19:
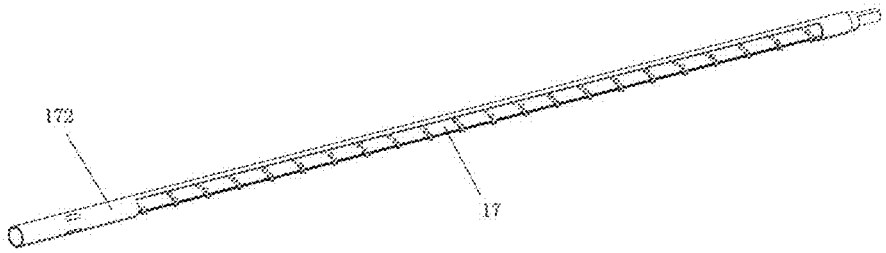
FIG. 19 is a schematic structural view when a brush roller housing is sleeved over a first brush roller according to Embodiment III of the present invention.

According to still another embodiment (Embodiment III), a scrubbing machine is configured to supplement water to the roller brush 11 through a first brush roller 17. As shown in FIG. 19, a scrubbing housing 172 is sleeved over the first brush roller 17, and the first brush roller 17 is configured to rotate in the scrubbing housing 172. The first protrusion structures and/or the first hairbrush structures on the scrubbing roller shaft 171 of the brush roller are spirally arranged. An opening is provided on a side of the scrubbing housing 172 facing the roller brush 11. The scrubbing housing 172 is provided with at least one water inlet. The water inlet is communicated with an inner cavity of the scrubbing housing 172. The water inlet schematically shown in the figure is formed in an end surface of the scrubbing housing 172. In an implementation, the forming positions and number of the water inlets can be designed as needed. After water is introduced through the water inlet, when the first brush roller 17 rotates in the scrubbing housing 172, the first protrusion structures or the first hairbrush structures 16 spirally arranged can play a water conveying role, and can throw the clean water into the roller brush 11. The water supplementation mode in this embodiment is also suitable for all implementations in Embodiment I. For example, the water supplementation mode can be suitable for either the implementation where water is not supplemented to the dirt holding tank 12 or implementation where water is supplemented to the dirt holding tank 12. Or, the water supplementation mode can be suitable for either the implementation with the pressure roller 15 or the implementation without the pressure roller 15 and the like.

Figure 20:
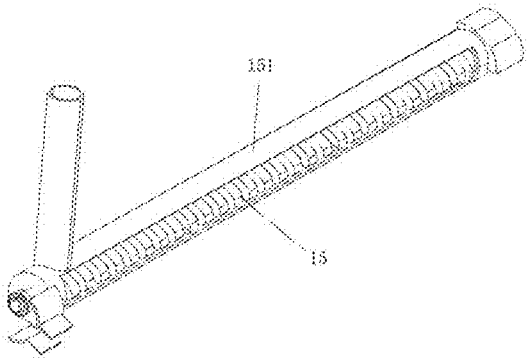
FIG. 20 is a schematic structural view of a pressure roller housing sleeved over a pressure roller from one perspective according to Embodiment IV of the present invention.
Figure 21:
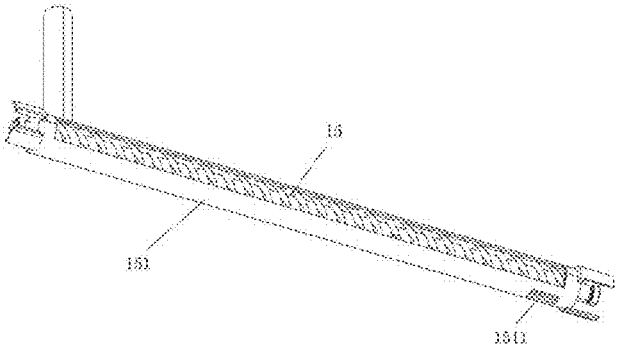
FIG. 21 is a schematic structural view of the pressure roller housing sleeved over the pressure roller from another perspective according to Embodiment IV of the present invention.

According to one embodiment (Embodiment IV), a scrubbing machine is configured to supplement water to the roller brush 11 through the pressure roller 15. As shown in FIG. 20 and FIG. 21, different from Embodiment I, a pressure roller housing 151 is sleeved over the pressure roller 15, and the pressure roller 15 is configured to rotate in the pressure roller housing 151. In this embodiment, a threaded groove is formed in a surface of the pressure roller 15. An opening is provided on a side of the pressure roller housing 151 facing the roller brush 11. Through the opening, the pressure roller 15 can press the roller brush 11. The pressure roller housing 151 is provided with at least one water inlet and at least one water outlet 1511. The water outlet 1511 is communicated with an inner cavity of the pressure roller housing 151 and an inner cavity of the dirt holding tank 12. The water inlet schematically shown in the figure is formed in a side surface, close to one end, of the pressure roller housing 151. The water outlet 1511 is formed at a position, close to the other end, of the bottom of the pressure roller housing 151, as shown in FIG. 21, so that the water in the pressure roller housing 151 can flow into the dirt holding tank 12 smoothly. In an implementation, the forming positions and number of the water inlets and water outlets 1511 can be designed as needed. After water is introduced through the water inlet, because the threaded groove is formed in the pressure roller 15, the clean water added into the pressure roller housing 151 will be conveyed in the pressure roller housing 151 with rotation of the pressure roller 15, so that the cleaning layer 111 of the roller brush 11 can further be cleaned to a certain extent while the water is supplemented to the roller brush 11. The water supplementation mode in this embodiment is also suitable for all implementations in Embodiment I. For example, the water supplementation mode can be suitable for either the implementation where water is not supplemented to the dirt holding tank 12 or implementation where water is supplemented to the dirt holding tank 12. Or, the water supplementation mode can be suitable for either the implementation with the pressure roller 15 or the implementation without the pressure roller 15 and the like. The water supplementation mode is further suitable for the water supplementation modes in Embodiment II or III together.

Figure 22:
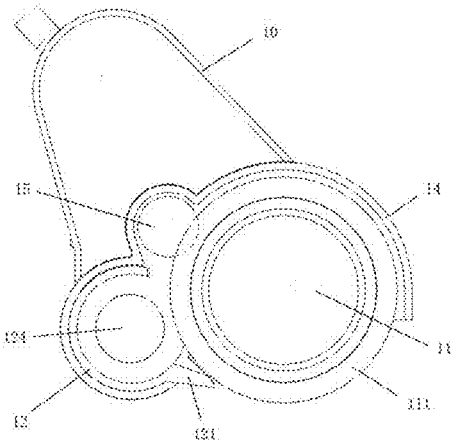
FIG. 22 is a schematic sectional structural view of a scrubbing machine according to Embodiment V of the present invention.

According to one embodiment (Embodiment V), as shown in to FIG. 22, schematically shown is another scrubbing machine, comprising a roller brush 11, a dirt holding tank 12, a pressure roller 15 and a water blocking cover 14. The roller brush 11 is a water-absorbent roller brush. The roller brush usually comprises a water-absorbent plush cotton roller brush or a water-absorbent sponge roller brush such as polyvinyl alcohol sponge, i.e., a cleaning layer 111 is made of wool or sponge. A length direction of the dirt holding tank 12 is the same as an axial direction of the roller brush 11, the dirt holding tank 12 is located on one side of the roller brush 11, and an opening is provided on a side of the dirt holding tank 12 facing the roller brush 11.

The dirt holding tank 12 is provided with at least one drain outlet 124. As shown in FIG. 22, it is schematically shown that an end of the dirt holding tank 12 is provided with the drain outlet 124. In an implementation, a position of the drain outlet 124 is not limited. The drain outlet can be formed in any position of the dirt holding tank 12, for example a side wall and the like. The dirt holding tank 12 and the number of the drain outlets 124 can be adjusted as needed. A suction machine 2 such as a vacuum cleaner is externally connected to the drain outlet 124 of the dirt holding tank 12 to suck the dirty water or dirt in the dirt holding tank 12 to a designated position, for example, out of the machine, or an accommodation machine 3 such as a water tank. In addition, the dirt holding tank 12 can further be provided with a water inlet 125. When the water tank and the water pumping machine 4 are also provided, water is supplemented to the dirt holding tank 12, which can flush the dirt left in the dirt holding tank 12 to a certain extent, so as to clean the dirt holding tank 12.

A guide structure 121 extends from a lower edge of the opening of the dirt holding tank 12. An end, away from dirt holding tank 12, of the guide structure 121 inclines downwards, as shown in FIG. 11. The structure is like the structure of a dustpan. In an implementation, the guide structure will be close to the floor and match with the roller brush 11, so that the cleaning capacity of the roller brush 11 can be improved, and dirty water leakage of the roller brush 11 is reduced.

An axial direction of the pressure roller 15 is the same as that of the roller brush 11, the pressure roller 15 is located above the dirt holding tank 12, and the pressure roller 15 presses one side of the roller brush 11. When the roller brush 11 rotates, the roller brush 11 drives the pressure roller 15 to rotate. The pressure roller 15 rolls and squeezes the cleaning layer 111 on the surface of the roller brush 11 to squeeze out the dirty water in the cleaning layer 111 and the dirty water flows into the dirt holding tank 12. Moreover, the dirty water will take away part of dirt on the surface of the cleaning layer 111. A degree of tightness between the pressure roller 15 and the roller brush 11 is adjustable. For example, the degree of tightness is adjusted by way of a tensioning member or an expansion member 152, and the like. The mode shown in FIG. 11 is an expansion mode. The expansion members 152 are springs which are respectively arranged at both ends of the pressure roller 15. The springs are compressed all the time to guarantee that a certain pressure is kept between the pressure rod and the roller brush 11, so that the surface of the roller brush 11 can be better squeezed. Moreover, the pressure between the roller brush 11 and the pressure roller 15 can be adjusted by flexibly adjusting the elastic forces of the springs, i.e., the distance between the pressure roller 15 and the roller brush 11 is adjusted as needed to control the wetting degree and the cleaning degree of the roller brush 11. Of course, a tensioning mode or other modes can also be used to adjust the degree of tightness between the roller brush 11 and the pressure roller 15 as long as the degree of tightness between the pressure roller 15 and the roller brush 11 is within the protection scope of the present invention, which is not described repeatedly here. The pressure roller 15 and the roller brush 11 are another two cylinders which rotate oppositely and squeeze each other to further squeeze the roller brush 11, so that water is further squeezed out. Moreover, large particle dirt can be blocked to a certain extent, the resistance to the roller brush 11 is lower, the driving power of the roller brush 11 is reduced, and the cost is reduced. A threaded groove can further be arranged in the surface of the pressure roller 15, which can also satisfy the same effect.

The water blocking cover is arranged above the roller brush 11 and the pressure roller 15 configured to shield the roller brush 11 and the pressure roller 15 to prevent the dirty water or dirt on the roller brush 11 and the pressure roller 15 from being thrown out of the machine. One end of the water blocking cover 14 extends to the dirt holding tank 12. It should be known that the water blocking cover 14 and the dirt holding tank 12 can be separated, i.e., one end of the water blocking cover 14 is hermetically connected to the dirt holding tank 12 or the water blocking cover 14 and the dirt holding tank 12 are integrated. Regardless of the separated or integrated structures, such structures are provided to guarantee that the dirty water and dirt thrown by the roller brush 11 and the pressure roller 15 can smoothly enter the dirt holding tank.

Figure 24:
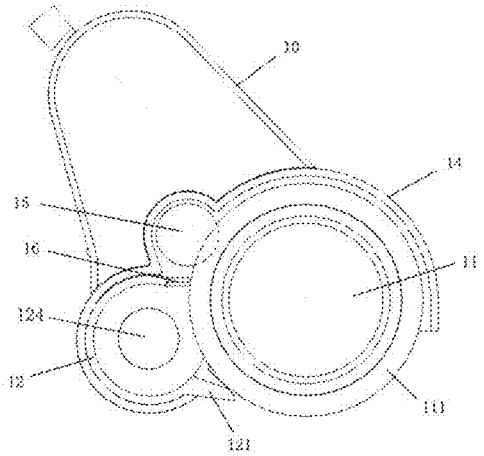
FIG. 24 is a schematic sectional structural view of the scrubbing machine when protrusion structures or the hairbrush structures are arranged at an edge of a dirt holding tank according to Embodiment V or VI of the present invention.

In a further embodiment, the multiple first protrusion structures and/or multiple first hairbrush structures can be arranged on one side of the roller brush 11, and the first protrusion structures or the first hairbrush structures abut against the roller brush 11. The first hairbrush structures are preferably tufts. The first protrusion structures or the first hairbrush structures 16 are arranged below the pressure roller 15. The following two modes for the first protrusion structures and/or the first hairbrush structures are provided:

Mode I: the first protrusion structures or the first hairbrush structures are arranged at an upper edge of the opening of the dirt holding tank 12, as shown in FIG. 24. The upper edge of the opening of the dirt holding tank 12 shown in the figure is zigzag for a purpose that the dirty water and dirt above the dirt holding tank 12 can smoothly enter the dirt holding tank 12. The first protrusion structures or the first hairbrush structures are respectively arranged on the zigzag structure of the upper edge. Of course, the first protrusion structures or the first hairbrush structures can also be arranged in a tooth space of the upper edge. It should be known that the edge of the opening of the dirt holding tank 12 can be only provided with the first protrusion structures or the first hairbrush structures. The edge of the opening of the dirt holding tank is provided with both the first protrusion structures and the first hairbrush structures. The first protrusion structures and the first hairbrush structures are both arranged in different modes as needed. In addition, the upper edge of the opening of the dirt holding tank 12 may not be zigzag, and it is also feasible that a gap is formed between the upper edge of the opening of the dirt holding tank and the roller brush 11.

Figure 25:
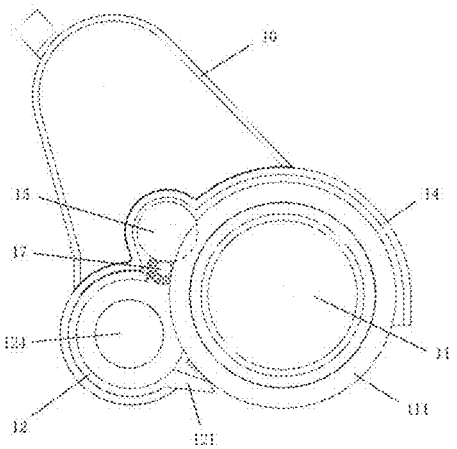
FIG. 25 is a schematic sectional structural view of the scrubbing machine provided with a first brush roller according to Embodiment V or VI of the present invention.
Figure 26:
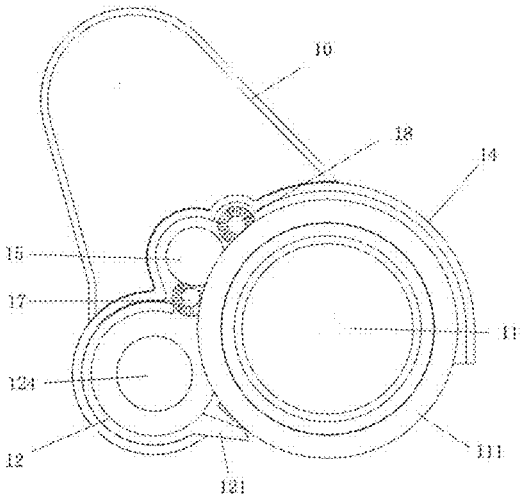
FIG. 26 is a schematic sectional structural view of the scrubbing machine provided with two brush rollers according to Embodiment V or VI of the present invention.

Mode II: the first protrusion structures or the first hairbrush structures are arranged on a scrubbing roller shaft 171, as shown in FIG. 25. The structure is also known as a first brush roller 17. An axial direction of the scrubbing roller shaft 171 is the same as that of the pressure roller 15. The scrubbing roller shaft 171 is arranged on one side of the roller brush 11. Same as I, the scrubbing roller shaft 171 can be only provided with the first protrusion structures or the first hairbrush structures. The scrubbing roller shaft can also be provided with both the first protrusion structures and the first hairbrush structures. The first protrusion structures and the first hairbrush structures both can be arranged in different modes as needed.

Long or large dirt such as hairs and soybeans on the cleaning layer 111 of the roller brush 11 can be scraped into the dirt holding tank 12 through the first protrusion structures or the first hairbrush structures, and then the dirt is pumped out by the suction machine 2.

Regardless of I or II above, the long or large dirt such as hairs and soybeans on the cleaning layer 111 of the roller brush 11 can be scraped in advanced before the pressure roller 15 rolls and squeezes the roller brush 11, so that the self-cleaning effect of the scrubbing machine is improved. Moreover, the dirty water generated by the pressure roller 15 squeezing the roller brush 11 can further flush the hairbrush structures or protrusion structures to take the dirt left on the hairbrush structures or protrusion structures into the dirt holding tank 12. In addition, in II, the roller brush 11 rotates to drive the scrubbing roller shaft 171 to rotate to play a certain draining role while cleaning the cleaning layer 111 of the roller brush 11, so as to prevent water accumulation below the pressure roller 15 because the roller brush 11 rotates too fast. The scrubbing roller shaft 171 drives the first protrusion structures or the first hairbrush structures to rotate to throw the dirty water and dirt squeezed by the pressure roller 15 into the dirt holding tank 12, so that the dirty water discharging capacity of the scrubbing machine is improved.

In a further embodiment, the pressure roller 15 can further be provided with one or more scraping brushes on one side of the rotating direction of the roller brush 11. The scraping brush can be a second brush roller 18. An axial direction of the second brush roller 18 is the same as that of the roller brush 11, and the brush roller presses one side of the roller brush 11. The second brush roller 18 and the first pressure roller 15 can be same in structure. After long-term use or in a using process, the pressure roller 15 squeezes the surface of the roller brush 11 to a smooth surface, i.e., wool or sponge adhered, so that the adsorption capacity of the roller brush 11 is reduced, and the using effect is reduced. A brush roller is further arranged behind the pressure roller 15. The roller brush 11 rotates to drive the brush roller to roll, so that the protrusion structures or hairbrush structures on the brush roller will take up or brush up the wool or sponge on the surface of the roller brush 11, and therefore, adsorption capacity of the roller brush 11 and a friction force to the floor are effectively improved, and the cleaning effect of the machine is improved. It should be known that the scraping brush can also be a non-rotatable brush and the like, which, in a similar way, can satisfy the design requirements.

In a further embodiment, the scrubbing machine further comprises a driving machine 19, where the driving machine 19 is configured to drive the roller brush 11 to rotate. The driving machine 19 is preferably a driving motor. FIG. 17 schematically shows a driving mode that the driving machine 19 is arranged outside the roller brush 11, for example, above the water blocking cover 14, then the driving machine is closed by a housing 10, and the roller brush 11 is driven by matching a driving belt with a gear. Of course, the driving machine 19 can also be arranged inside the roller brush 11 and the like, and driving modes used for driving the roller brush 11 all are within the protection scope of the present invention, which are not described repeatedly here.

In a further embodiment, the scrubbing machine further comprises an electricity storage machine 191 such as a battery, where the electricity storage machine 191 is electrically connected to the driving machine 19 to power the driving machine 19. By additionally providing the electricity storage machine 191, the scrubbing machine can be used as an independent cleaning machine.

In a further embodiment, the scrubbing machine in this embodiment can also supplement water to the roller brush 11 through the pressure roller 15. A specific mode is substantially consistent with that of Embodiment IV, which is not repeatedly described here.

In a further embodiment, the scrubbing machine in this embodiment can also supplement water to the roller brush 11 through the first brush roller 17. A specific mode is substantially consistent with that of Embodiment II or III, which is not repeatedly described here. It should be known that in this embodiment, water supplementation by the pressure roller 15 and water supplementation by the first brush roller 17 can be used independently, or water supplementation by the pressure roller and water supplementation by the first brush roller both can be used in an implementation.

Figure 23:
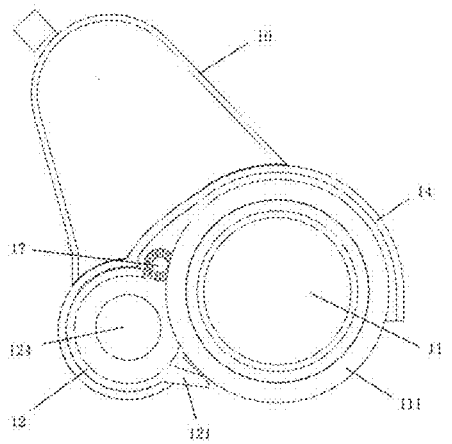
FIG. 23 is a schematic sectional structural view of a scrubbing machine according to Embodiment VI of the present invention.

According to one embodiment (Embodiment VI), as shown in FIG. 23, a scrubbing machine comprises a roller brush 11, a dirt holding tank 12, a first brush roller 17 and a water blocking cover 14. The roller brush 11 is a water-absorbent roller brush. The roller brush 11 usually comprises a water-absorbent plush cotton roller brush or a water-absorbent sponge roller brush such as polyvinyl alcohol sponge, i.e., a cleaning layer 111 is made of wool or sponge. A length direction of the dirt holding tank 12 is the same as an axial direction of the roller brush 11, the dirt holding tank 12 is located on one side of the roller brush 11, and an opening is provided on a side of the dirt holding tank 12 facing the roller brush 11.

The dirt holding tank 12 is provided with at least one drain outlet 124. As shown in FIG. 23, it is schematically shown that an end of the dirt holding tank 12 is provided with the drain outlet 124. In an implementation, a position of the drain outlet 124 is not limited. The drain outlet can be formed in any position of the dirt holding tank 12, for example a side wall and the like. The dirt holding tank 12 and the number of the drain outlets 124 can be adjusted as needed. A suction machine 2 such as a vacuum cleaner is externally connected to the drain outlet 124 of the dirt holding tank 12 to suck the dirty water or dirt in the dirt holding tank 12 to a designated position, for example, out of the machine, or an accommodation machine 3 such as a water tank. In addition, the dirt holding tank 12 can further be provided with a water inlet 125. When the water tank and the water pumping machine 4 are also provided, water is supplemented to the dirt holding tank 12, which can flush the dirt left in the dirt holding tank 12 to a certain extent, so as to clean the dirt holding tank 12.

A guide structure 121 extends from a lower edge of the opening of the dirt holding tank 12. An end, away from dirt holding tank 12, of the guide structure 121 inclines downwards. The structure is like the structure of a dustpan. In an implementation, the guide structure will be close to the floor and match with the roller brush 11, so that the cleaning capacity of the roller brush 11 can be improved, and dirty water leakage of the roller brush 11 is reduced.

An axial direction of the first brush roller 17 is the same as that of the roller brush 11, the first brush roller 17 is located at an opening of the dirt holding tank 12, and the first brush roller 17 presses one side of the roller brush 11. The first brush roller 17 comprises a scrubbing roller shaft 171 and multiple first protrusion structures and/or multiple first hairbrush structures arranged on the scrubbing roller shaft 171, and the first protrusion structures or the first hairbrush structures abut against the roller brush 11. The first hairbrush structures are preferably tufts. It should be known that the scrubbing roller shaft 171 can be only provided with the first protrusion structures or the first hairbrush structures. The scrubbing roller shaft can also be provided with both the first protrusion structures and the first hairbrush structures. The first protrusion structures and the first hairbrush structures both can be arranged in different modes as needed. Long or large dirt such as hairs and soybeans on the cleaning layer 111 of the roller brush 11 can be scraped into the dirt holding tank 12 through the first protrusion structures or the first hairbrush structures, and then the dirt is pumped out by the suction machine 2.

The water blocking cover is arranged above the roller brush 11 and the first brush roller 17 configured to shield the roller brush 11 and the first brush roller 17 to prevent the dirty water or dirt on the roller brush 11 and the first brush roller 17 from being thrown out of the machine. One end of the water blocking cover 14 extends to the dirt holding tank 12. It should be known that the water blocking cover 14 and the dirt holding tank 12 can be separated, i.e., one end of the water blocking cover 14 is hermetically connected to the dirt holding tank 12 or the water blocking cover 14 and the dirt holding tank 12 are integrated. Regardless of the separated or integrated structures, such structures are provided to guarantee that the dirty water and dirt thrown by the roller brush 11 and the first brush roller 17 can smoothly enter the dirt holding tank 12.

In a further embodiment, a pressure roller 15 can also be arranged above the first brush roller 17, as shown in FIG. 25. An axial direction of the pressure roller 15 is the same as that of the roller brush 11, the pressure roller 15 is located above the dirt holding tank 12, and the pressure roller 15 presses one side of the roller brush 11. When the roller brush 11 rotates, the roller brush 11 drives the pressure roller 15 to rotate. The pressure roller 15 rolls and squeezes the cleaning layer 111 on the surface of the roller brush 11 to squeeze out the dirty water in the cleaning layer 111 and the dirty water flows into the dirt holding tank 12. Moreover, the dirty water will take away part of dirt on the surface of the cleaning layer 111. A degree of tightness between the pressure roller 15 and the roller brush 11 is adjustable. For example, the degree of tightness is adjusted by way of a tensioning member or an expansion member 152, and the like. The mode shown in FIG. 11 is an expansion mode. The expansion members 152 are springs which are respectively arranged at both ends of the pressure roller 15. The springs are compressed all the time to guarantee that a certain pressure is kept between the pressure rod and the roller brush 11, so that the surface of the roller brush 11 can be better squeezed. Moreover, the pressure between the roller brush 11 and the pressure roller 15 can be adjusted by flexibly adjusting the elastic forces of the springs, i.e., the distance between the pressure roller 15 and the roller brush 11 is adjusted as needed to control the wetting degree and the cleaning degree of the roller brush 11. Of course, a tensioning mode or other modes can also be used to adjust the degree of tightness between the roller brush 11 and the pressure roller 15 as long as the degree of tightness between the pressure roller 15 and the roller brush 11 is within the protection scope of the present invention, which is not described repeatedly here. The pressure roller 15 and the roller brush 11 are another two cylinders which rotate oppositely and squeeze each other to further squeeze the roller brush 11, so that water is further squeezed out. Moreover, large particle dirt can be blocked to a certain extent, the resistance to the roller brush 11 is lower, the driving power of the roller brush 11 is reduced, and the cost is reduced. Moreover, the dirty water generated by the pressure roller 15 squeezing the roller brush 11 can further flush the first brush roller 17 to take the dirt left on the first brush roller 17 into the dirt holding tank 12. A threaded groove can further be arranged in the surface of the pressure roller 15, which can also satisfy the same effect.

In a further embodiment, the pressure roller 15 can further be provided with one or more scraping brushes on one side of the rotating direction of the roller brush 11. The scraping brush can be a second brush roller 18. An axial direction of the second brush roller 18 is the same as that of the roller brush 11, and the brush roller presses one side of the roller brush 11. The second brush roller 18 and the first brush roller 17 can be same in structure. In the above implementation that the cleaning effect of the cleaning layer 111 of the roller brush 11 is implemented by way of squeezing the roller brush 11 by the pressure roller 15, after long-term use or in a using process, the pressure roller 15 squeezes the surface of the roller brush 11 to a smooth surface, i.e., wool or sponge adhered, so that the adsorption capacity of the roller brush 11 is reduced, and the using effect is reduced. A brush roller is further arranged behind the pressure roller 15. The roller brush 11 rotates to drive the brush roller to roll, so that the protrusion structures or hairbrush structures on the brush roller will take up or brush up the wool or sponge on the surface of the roller brush 11, and therefore, adsorption capacity of the roller brush 11 and a friction force to the floor are effectively improved, and the cleaning effect of the machine is improved. It should be known that the scraping brush can also be a non-rotatable brush and the like, which, in a similar way, can satisfy the design requirements.

In a further embodiment, the scrubbing machine further comprises a driving machine 19, where the driving machine 19 is configured to drive the roller brush 11 to rotate. The driving machine 19 is preferably a driving motor. FIG. 17 schematically shows a driving mode that the driving machine 19 is arranged outside the roller brush 11, for example, above the water blocking cover 14, and the roller brush 11 is driven by matching a driving belt with a gear. Of course, the driving machine 19 can also be arranged inside the roller brush 11 and the like, and driving modes used for driving the roller brush 11 all are within the protection scope of the present invention, which are not described repeatedly here.

In a further embodiment, the scrubbing machine further comprises an electricity storage machine 191 such as a battery, where the electricity storage machine 191 is electrically connected to the driving machine 19 to power the driving machine 19. By additionally providing the electricity storage machine 191, the scrubbing machine can be used as an independent cleaning machine.

In a further embodiment, the scrubbing machine in this embodiment can also supplement water to the roller brush 11 through the first brush roller 17. A specific mode is substantially consistent with that of Embodiment II or III, which is not repeatedly described here.

In a further embodiment, the scrubbing machine in this embodiment can also supplement water to the roller brush 11 through the pressure roller 15. A specific mode is substantially consistent with that of Embodiment IV, which is not repeatedly described here.

It should be known that in this embodiment, water supplementation by the first brush roller 17 and water supplementation by the pressure roller 15 can be used independently, or water supplementation by the pressure roller and water supplementation by the first brush roller both can be used in an implementation.

In addition, in Embodiment I to Embodiment VI, the pressure roller 15, the first brush roller 17, the second brush roller 18 or the threaded water pumping and conveying rod 13 all can be driven independently by the driving machine 19, or driven by the roller brush 11 in a linked manner, or by the roller brush 11 in a passive operation.

Figure 27:
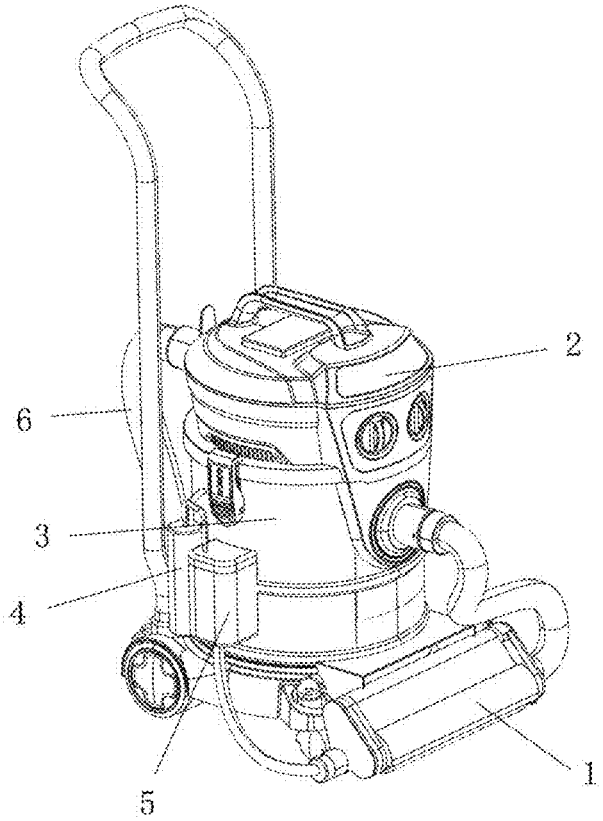
FIG. 27 is a schematic structural view of a self-cleaning floor cleaning machine from one perspective according to Embodiment VII of the present invention.
Figure 28:
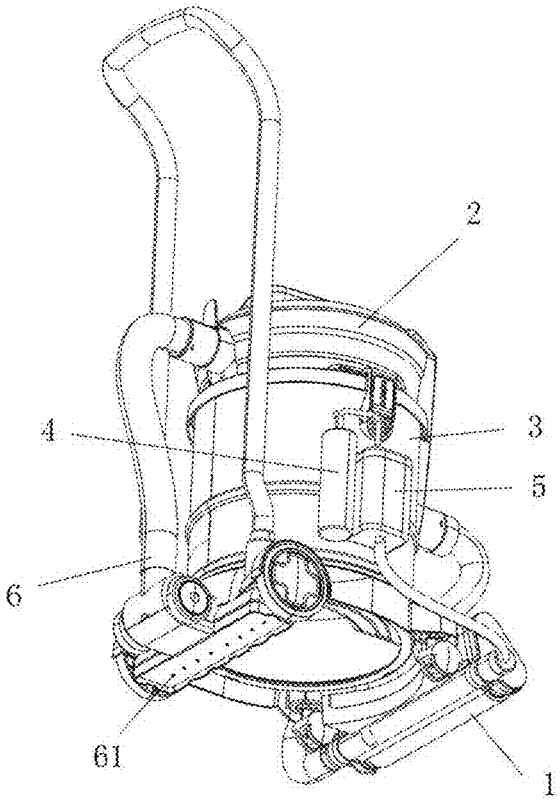
FIG. 28 is a schematic structural view of the self-cleaning floor cleaning machine from another perspective according to Embodiment VII of the present invention.
Figure 29:
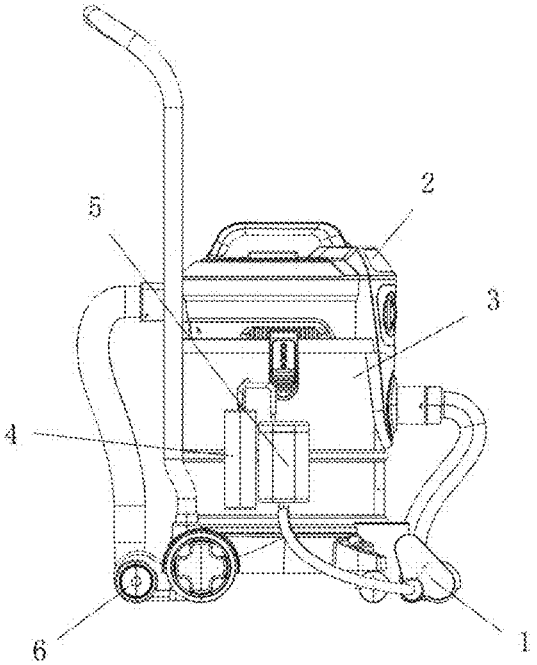
FIG. 29 is a schematic side structural view of the self-cleaning floor cleaning machine according to Embodiment VII of the present invention.

According to one embodiment (Embodiment VII), a self-cleaning floor cleaning machine comprises a scrubbing machine 1, a suction machine 2 and at least one accommodation machine 3. As shown in FIG. 27 to FIG. 29, schematically shown is a commercially available barrel suction self-cleaning floor cleaning machine, where the accommodation machine 3 thereof is barrel-shaped, the scrubbing machine 1 and the accommodation machine 3 are both mounted on a base, and the suction machine 2 is mounted in the accommodation machine 3. In order to implement a smooth movement, preferably, universal wheels can also be mounted on the base for the convenience of movement, and the height of the water tank can be also improved to a certain extent. It should be known that the solution of the example in FIG. 27 to FIG. 29 is only a schematic solution. In an implementation, the specific shape and structure of the self-cleaning floor cleaning machine can be designed as needed. Moreover, the scrubbing machine 1 and the suction machine 2 can also be detachably mounted as accessories.

Figure 30:
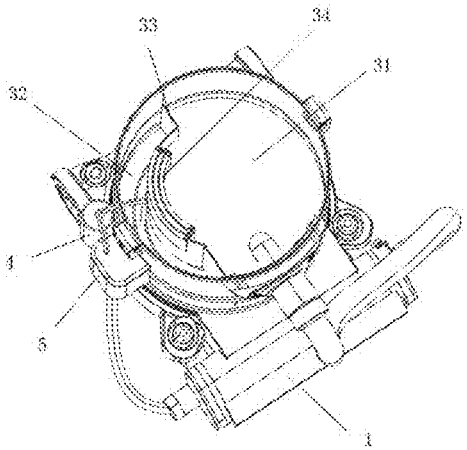
FIG. 30 is a schematic structural view of the self-cleaning floor cleaning machine without a suction machine according to Embodiment VII of the present invention.
Figure 31:
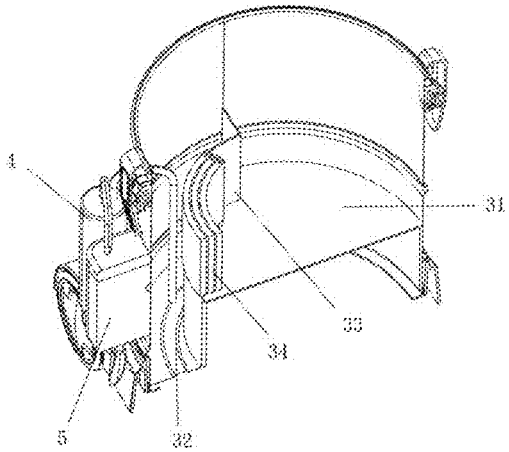
FIG. 31 is a sectional structural view of FIG. 30.

The scrubbing machine 1 may be any one machine in the above Embodiment I to Embodiment VI. The suction machine 2 is configured to suck the dirty water or dirt in the dirt holding tank 12 to the accommodation machine 3. In a further embodiment, a dirty water cavity 31 and a clean water cavity 32 are formed in the accommodation machine 3. The dirty water cavity 31 is communicated with the clean water cavity 32. A filter machine 34 is arranged between the dirty water cavity 31 and the clean water cavity 32. The suction machine 2 is configured to suck the dirty water or dirt in the dirt holding tank 12 to the dirty water cavity 31. Preferably, the dirty water cavity 31 and the clean water cavity 32 are horizontally arranged, and the dirty water cavity 31 and the clean water cavity 32 are separated by a separation structure 33, as shown in FIG. 30. The separation structure 33 is provided with a permeable hole, and the filter machine 34 is mounted on the permeable hole. The filter machine 34 can either be a multi-layered filter element or other filter structures. A bottom of the clean water cavity 32 is lower than a bottom of the dirty water cavity 31, as shown in FIG. 31, so that it is convenient to filter the dirty water in the accommodation machine and to further store much clean water.

In this embodiment, the floor cleaning machine further comprises a water pumping machine 4. The water pumping machine 4 can be either a water suction pump or other water pumping machines 4. A water pumping opening of the water pumping machine 4 is communicated with the clean water cavity 32. Due to a sunken design of the clean water cavity 32, and a desire of storing much clean water as well, the water pumping opening of the water pumping machine 4 is communicated with the clean water cavity 32 from a high position of an inner wall of the accommodation machine 3, and a hollow tube inserted into the bottom of the clean water cavity 32 is provided in the clean water cavity 32 to pump the clean water conveniently. It should be known that the above is only the preferred solution. In an implementation, more, for example, two accommodation machines 3 can be provided, one used as the dirty water tank and the other used as the clean water tank. Moreover, when no water pumping machine 4 is provided, the accommodation machine 3 can be only used as the dirty water tank to store the dirt or dirty water. The water outlet of the water pumping machine 4 is respectively communicated with the scrubbing roller shaft 171 or the scrubbing housing 172 or the dirt holding tank 12 or the water inlet of the scrubbing housing 172 in Embodiment I to Embodiment VI.

In a further embodiment, a standby water tank 5 is further connected to the water outlet of the water pumping machine 4, as shown in FIG. 27. Preferably, the standby water tank 5 is mounted outside the accommodation machine 3, which can implement observing the water storage amount in the accommodation machine 3, and can implement supplementing water conveniently, i.e., water can be supplemented to the whole machine only by supplementing water to the standby water tank 5 without opening the accommodation machine 3, so that the using convenience of the machine is improved.

In an embodiment, the floor cleaning machine further comprises a blowing machine 6. As shown in FIG. 28, the blowing machine 6 is also mounted on the base. Of course, same as the scrubbing machine 1 and the suction machine 2, the blowing machine 6 can also be designed to be detachable as an accessory. The blowing machine 6 comprises a blowing head and a pipeline. A communication between an inner cavity of the blowing head and an exhaust opening of the suction machine 2 is allowed by the pipeline. Moreover, the blowing head is provided with multiple air holes 61, the air holes 61 are communicated with the inner cavity of the blowing head, and the air holes 61 face the floor. The suction machine 2 works to generate and exhaust certain heat air, and the heat air is guided to the floor scraped by the scrubbing machine 1, which can implement air-drying the floor to a certain extent.

In addition, it should be known that in an implementation, by setting an intelligent module, the self-cleaning floor cleaning machine in the present invention can work intelligently.

The terms "comprise", "comprise", or any other variation thereof in this specification are intended to cover a non-exclusive inclusion. Besides those elements listed, the terms can also comprise other elements which are not specifically listed.

Orientation terms such as front, rear, upper, lower, and the like involved in this specification are defined based on location of parts in the figures and relative positions of the parts, for clear and convenient expression of the technical solutions. It should be understood that use of the orientation terms should not limit the protection scope claimed by the present invention.

The above embodiments are preferred embodiments of the present invention and are not used to limit the present invention. Any modifications, equivalent replacements, improvements, etc. made within the spirit and principles of the present invention shall all fall within the scope of protection of the present invention.

What is claimed is:

1. A self-cleaning floor scrubbing machine, comprising:

a roller brush;

a dirt holding tank located on one side of the roller brush and being provided with an opening on a side of the dirt holding tank facing the roller brush and at least one drain outlet, wherein a length direction of the dirt holding tank is the same as an axial direction of the roller brush;

a threaded water pumping and conveying rod rotatably mounted in the dirt holding tank, wherein an axial direction of the threaded water pumping and conveying rod is the same as that of the roller brush; and a water blocking cover arranged above the roller brush, wherein one end of the water blocking cover extends to the dirt holding tank.

2. The self-cleaning floor scrubbing machine according to claim 1, further comprising:

a pressure roller located above the dirt holding tank and configured to press one side of the roller brush, wherein an axial direction of the pressure roller is the same as that of the roller brush; and/or a plurality of first protrusion structures and/or a plurality of first hairbrush structures arranged on one side of the roller brush and configured to abut against the roller brush.

3. The self-cleaning floor scrubbing machine according to claim 2, wherein the first protrusion structures and/or the first hairbrush structures are arranged at an upper edge of the opening of the dirt holding tank.

4. The self-cleaning floor scrubbing machine according to claim 2, further comprising:

a scrubbing roller shaft arranged on one side of the roller brush, wherein an axial direction of the scrubbing roller shaft is the same as that of the roller brush, and the first protrusion structures and/or the first hairbrush structures are arranged on the scrubbing roller shaft.

5. The self-cleaning floor scrubbing machine according to claim 4, wherein the scrubbing roller shaft is located below the pressure roller.

6. The self-cleaning floor scrubbing machine according to claim 5, wherein the scrubbing roller shaft is in a hollow tubular shape, the scrubbing roller shaft is provided with a plurality of water holes and at least one water inlet, and the water holes and the at least one water inlet are respectively communicated with an inner cavity of the scrubbing roller shaft.

7. The self-cleaning floor scrubbing machine according to claim 5, wherein a scrubbing housing is sleeved over the scrubbing roller shaft; the scrubbing roller shaft is configured to rotate in the scrubbing housing; the first protrusion structures and/or the first hairbrush structures on the scrubbing roller shaft are spirally arranged; an opening is provided on a side of the scrubbing housing facing the roller brush; the scrubbing housing is provided with at least one water inlet; and the least one water inlet is communicated with an inner cavity of the scrubbing housing.

8. The self-cleaning floor scrubbing machine according to claim 2, wherein a threaded groove is formed in a surface of the pressure roller.

9. The self-cleaning floor scrubbing machine according to claim 8, wherein a pressure roller housing is sleeved over the pressure roller; the pressure roller is configured to rotate in the pressure roller housing; an opening is provided on a side of the pressure roller housing facing the roller brush; the pressure roller housing is provided with at least one water inlet and at least one water outlet; and the at least one water outlet is communicated with an inner cavity of the pressure roller housing and an inner cavity of the dirt holding tank.

10. The self-cleaning floor scrubbing machine according to claim 2, wherein a pressing degree of tightness between the pressure roller and the roller brush is adjustable.

11. The self-cleaning floor scrubbing machine according to claim 1, wherein the threaded water pumping and conveying rod presses one side of the roller brush.

12. The self-cleaning floor scrubbing machine according to claim 1, wherein the dirt holding tank is provided with at least one water inlet;

a guide structure extends from a lower edge of the opening of the dirt holding tank, and an extended end of the guide structure inclines downwards;

the drain outlet of the dirt holding tank is connectable to a suction machine;

the threaded water pumping and conveying rod is provided with a plurality of second protrusion structures and/or a plurality of second hairbrush structures; and the threaded water pumping and conveying rod is a shaftless helical rod.

13. The self-cleaning floor scrubbing machine according to claim 2, further comprising:

a scraping brush located on one side of the pressure roller in a rotating direction of the roller brush, wherein an axial direction of the scraping brush is the same as that of the roller brush, and the scraping brush presses one side of the roller brush.

14. The self-cleaning floor scrubbing machine according to claim 1, further comprising:

a driving machine configured to drive the roller brush to rotate.

15. The self-cleaning floor scrubbing machine according to claim 14, further comprising:

an electricity storage machine being electrically connected to the driving machine.

* * * * *